United States Patent [19]

Dalmau Güell

[11] Patent Number: 4,625,528

[45] Date of Patent: Dec. 2, 1986

[54] YARN FEED DEVICE FOR A CIRCULAR KNITTING MACHINE

[75] Inventor: José M. Dalmau Güell, Barcelona, Spain

[73] Assignee: Jumberca, S.A., Badalona, Spain

[21] Appl. No.: 820,592

[22] Filed: Jan. 21, 1986

Related U.S. Application Data

[63] Continuation of Ser. No. 656,855, Oct. 2, 1984, abandoned.

[30] Foreign Application Priority Data

Oct. 7, 1983 [ES] Spain ..... 526625

[51] Int. Cl.[4] ..... D04B 15/48; D04B 15/58

[52] U.S. Cl. ..... 66/132 T; 66/138

[58] Field of Search ..... 66/132 R, 132 T, 138; 226/152, 181

[56] References Cited

U.S. PATENT DOCUMENTS

| | | | |
|---|---|---|---|
| 1,726,568 | 9/1929 | Jones et al. | 66/132 R |
| 2,247,244 | 6/1941 | Lawson | 66/132 R |
| 2,293,838 | 8/1942 | Lawson | 66/132 R |
| 2,432,685 | 12/1947 | Sawyer | 66/132 R |
| 3,418,831 | 12/1968 | Nance | 66/132 T |
| 3,451,603 | 6/1969 | Helffer et al. | 66/132 R X |

FOREIGN PATENT DOCUMENTS

| | | | |
|---|---|---|---|
| 610129 | 3/1935 | Fed. Rep. of Germany | 66/132 R |
| 1946559 | 3/1971 | Fed. Rep. of Germany | 66/132 R |

*Primary Examiner*—Wm. Carter Reynolds
*Attorney, Agent, or Firm*—Staas & Halsey

[57] ABSTRACT

A feed device for a circular knitting machine capable of positively feeding the needles with an adequate amount of yarn without the needles having to require the necessary yarn by pulling it and increasing its tension is disclosed. It comprises two sets of toothed rollers adapted to mesh without the respective teeth thereof making contact and a yarnguide for each pair of rollers capable of adopting an operative position in which the yarn guided by the eyelets of the yarnguide runs between the teeth or an inoperative position in which the yarn is spaced from the rollers. In the operative position it is contemplated that the rollers may be moved farther apart, whereby the yarn feed speed is reduced.

7 Claims, 12 Drawing Figures

41
56
57
39
34
38
12
10
11
7
18
30
60
6
40
55
58
59
63
61
62
4
5
1
2
3

12
13
10
17
14
8
25
9
11
III
III
20
16
7
37
19
22
18
21
38

YARN FEED DEVICE FOR A CIRCULAR KNITTING MACHINE

This is a continuation of co-pending application Ser. No. 656,855 filed on 10/2/84, now abandoned.

FIELD OF THE INVENTION

The invention relates to a yarn feed device for a circular knitting machine equipped with stripers mounted in association with each set of machine cams and also in association with a needle removal zone of the needle cylinder, each of said devices being formed by a plurality of yarnguides, normally four, selectively operated by a pattern drum indexed through a ratchet wheel by a rotary moving control in synchronism with the needle cylinder, said control operating at the most once on each and every one of the ratchet wheels on each rotation of the machine.

DESCRIPTION OF THE PRIOR ART

In the hitherto known circular knitting machines, the stripers are mounted on the periphery of the machine at the rate of one striper per cam set, each striper generally receiving four yarns three of which are retained by the striper and the other is delivered selectively to the needles so that in operation the needles are fed with one of the four yarns.

The changeover of the yarn fed to the needles by the striper, which determines the striping in the fabric, is carried out at the most once on each rotation of the machine and always in one same needle cylinder zone, namely the so-called needle removal zone, having a width of 20 to 30 needles, at the start of which certain needles have been removed, whereas in the remaining portion the needle density is less than in the remainder of the cylinder. Furthermore, in terry machines with stripers, terry sinkers are used in the needle removal zone instead of jersey knit sinkers.

In the known art, as said above, on a yarn changeover, the striper is actuated by a rotary moving control in synchronism with the needle cylinders, which control acts on a lever of the striper through pushers. The striper lever is provided with a pawl which indexes step by step a ratchet wheel attached to a pattern drum in which there are selectively inserted pins which cause levers associated with the moving yarnguides to rock. These yarnguides place the yarn in the path of the needles so that the latter pick it up and knit it. In the yarn changeover process, the yarn to be inserted is offered up so that the needles receive it and start knitting even while the previous yarn is still being knitted. Thus, for a short period of time, two yarns are being knitted simultaneously, namely the incoming yarn and the outgoing one.

In view of the foregoing, it is understandable that it is not possible for the conventional systems positively to feed the circular machines equipped with stripers, since:

only one of each four yarns is knit by the needles;

the yarn change is effected selectively depending on the characteristics of the fabric to be knitted;

on the rotations in which there is no yarn changeover, there appears equally the needle removal zone in which, particularly in terry fabrics, the amount of yarn required by the needles varies considerably.

SUMMARY OF THE INVENTION

The object of the invention is to provide a yarn feeder capable of overcoming the above drawbacks and of:

delivering a single yarn with positive feeding;

delivering the selected yarn in perfect synchronism with the striping changeover;

positively feeding with the adequate amount of yarn both the needles in the needle removal zone and the remaining needles, without the needles in any case demanding the necessary yarn by pulling it and increasing the tension thereof.

To this end, the yarn feed device according to the invention, being of the type described above, is characterised in that it comprises:

(a) two parallel facing shafts which rotate in synchronism and are separated from one another, each of said shafts having mounted thereon a set of identical toothed rollers such that each of the drive rollers of one set is adapted to mesh with a mating driven roller of the other set, the teeth of the rollers of one set being shifted relative to those of the other so that, in rotation, the teeth of the one penetrate between the teeth of the other without making contact at any point;

(b) operating spaces between the toothed rollers of each set;

(c) a bevelled corner on the toothed rollers facing the corresponding operating space;

(d) two pinions mounted respectively on the parallel shafts, one of them being adapted to cause the other pinion to rotate;

(e) a yarnguide for each operating space hingedly mounted on a shaft and comprising two eyelets defining a line capable of occupying an inoperative position extending through an operating space or an operative position extending between a pair of rollers;

(f) an actuating lever for each yarnguide;

(g) a support head for hingedly mounting one of said parallel shafts;

each of said yarnguide actuating levers being associated with the activating means of a different yarn of the striper at the same time as the support head of said one of said parallel shafts is associated with the drive means synchronised with the rotation of the circular knitting machine and acting upon the striper.

BRIEF DESCRIPTION OF THE DRAWINGS

Further aspects of the invention will be disclosed in detail in the following description to be read with reference to the accompanying illustrative drawings, in which.

DESCRIPTION OF THE PREFERRED EMBODIMENTS

The purpose of the striper 1 used in the invention is to supply the needles 2 of a circular knitting machine with the striping yarn 4 fed at the speed required by the needle consumption for knitting the desired fabric and partially to reduce the feed in the needle removal zone. When the fabric so requires, the feed yarn is changed over without tense points in the incoming yarn or overfeeding of the outgoing yarn, the whole changeover cycle being carried out.

Figure 1:
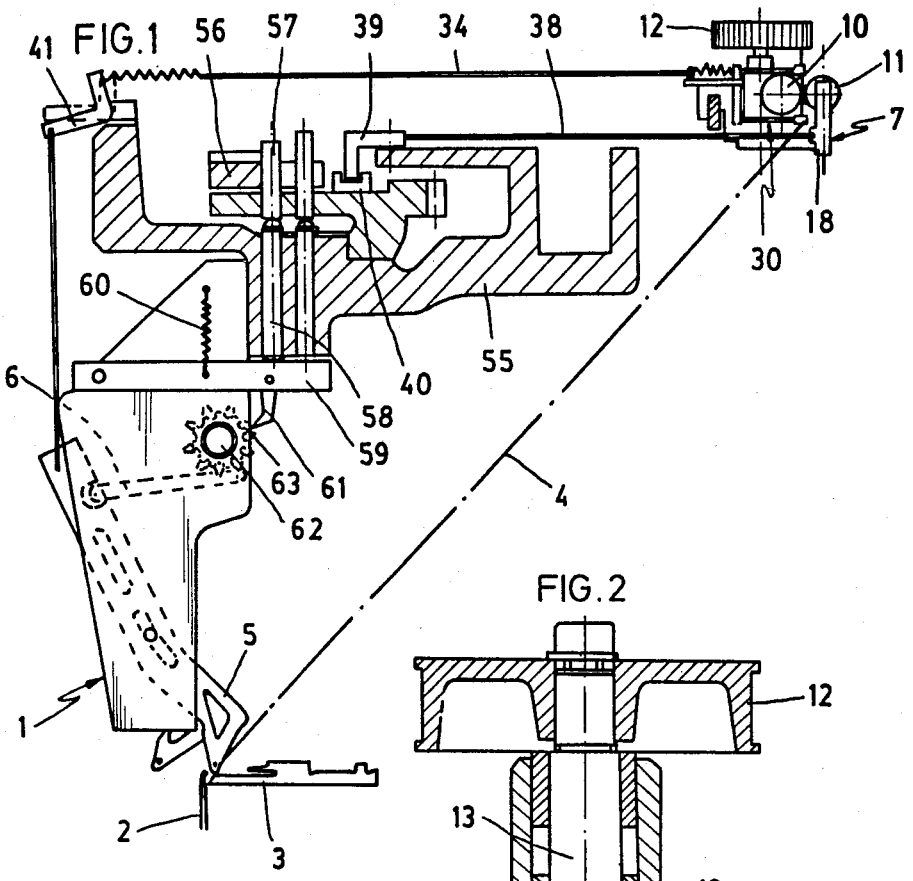
FIG. 1 is a part schematic view of a yarn feed device according to a first, preferred embodiment of the invention associated with the corresponding striper, mounted on a circular knitting machine.
Figure 2:
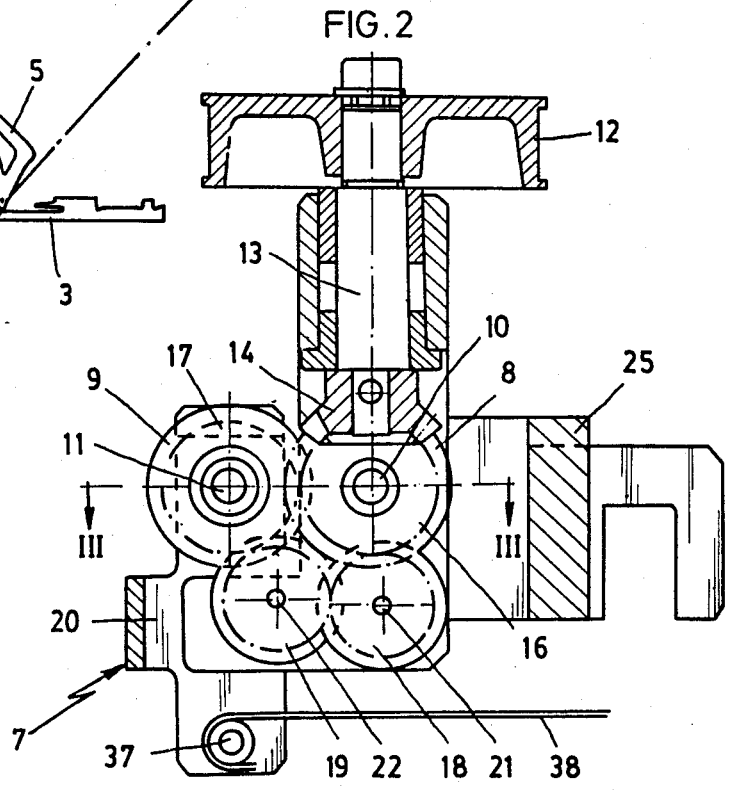
FIG. 2 is a front view of the yarn feed device drive mechanism, longitudinally through the drive means thereof, the latter being shown in section.
Figure 3:
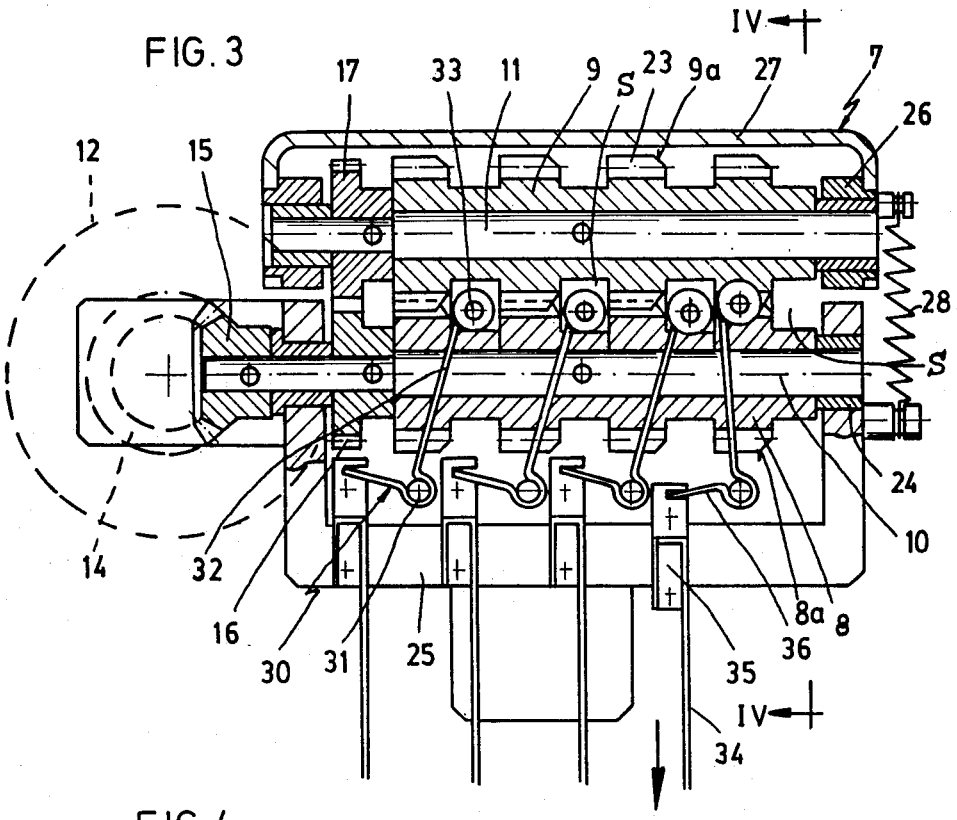
FIG. 3 is a cross section view of the yarn feed device and the drive means therefor, on the line III—III of FIG. 2.

These operations are performed from the movement of the corresponding moving yarnguide 5 of the striper 1 which, in turn, is driven by levers 6 from a knuckle joint as shown in FIG. 1. The apparatus comprises a feed mechanism 7, object of the invention which, as shown in FIGS. 2 and 3, comprises a set of toothed driving rollers 8 and a further set of driven rollers 9 mounted on respective parallel drive and driven shafts 10 and 11. Said rollers mesh with one another without making any contact, only for the purpose of pulling the yarn along by the alternate friction effect as the yarn passes between the teeth. The rollers of each set are spaced apart and each pair of rollers 8, 9 of each set defines an operating space S, the face of the roller 8 (9) facing the operating space S being provided with a bevelled surface 8*a* (9*a*). The function of the bevelled surface 8*a* (9*a*) of the toothed driving roller 8 (9) is merely to facilitate the passage of the yarn from the neutral or inoperative area to the operating space, wherein the rollers pick up the yarn and deliver it at a constant speed to the needles.

To drive the rollers 8, 9 of the feed device there is provided a drive pulley 12 mounted on a shaft 13 carrying a bevel gear 14 meshing with a further bevel gear 15 mounted on the shaft 10, to which there is also attached a drive pinion 16. Pinion 16 drives a further driven pinion 17 attached to the shaft 11 of the other toothed roller 9, through two intermediate pinions 18 and 19 having respective shafts 21 and 22. A support head 27 supports the shafts 11 and 22 and pivots around shaft 22 and when the pivoting takes place, the teeth 23 of the rollers 8 and 9 come out of mesh. Conversely, in the meshed position, the teeth 23 of said rollers never make mutual contact, so that the yarn 4 is pulled along without suffering any damage and without losing the prior synchronism of rotation of said rollers 8 and 9.

The shaft 10 is mounted in bearings 24 in the mechanism housing 25, while the shaft 11 is mounted in further bearings 26 in the head 27, which is urged against the housing 25 by a spring 28.

There is a plurality of toothed rollers 8, 9 on each shaft 10, 11, four are shown in FIG. 3, since this is the usual number and they correspond to four striping yarns 4, although only one of them intervenes in each operation.

Figure 4:
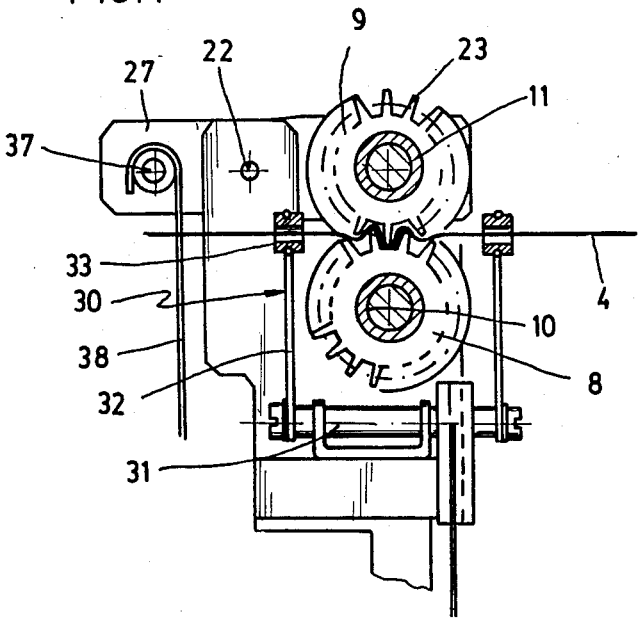
FIG. 4 is a cross section on the line IV—IV of FIG. 3, showing the yarn feed device delivering a yarn; in this Figure the pinions have been omitted and the eyelets are shown in section for greater clarity.

The feed device receives the corresponding yarn 4 through yarnguides 30, each of which comprises a shaft 31 with two arms 32 each provided with an eyelet 33, one on the inlet side and the other on the outlet side, as seen in FIG. 4. For each operating space S corresponding to the rollers 8, 9, there is a yarnguide 30. One of such yarnguides is in an operative position and the remainder are inoperative, as seen in FIG. 3. Tiebars 34 act upon a terminal block 35 for a lever arm 36 of the yarnguide 30. Each pair of eyelets 33 defines a line which in an inoperative yarnguide 30 extends through the corresponding operating space S and in the operative yarnguide extends through a pair of rollers 8, 9.

The head 27 pivots about the shaft 22 of the pinion 19 and is actuated from point 37 by a tiebar 38 connected to a slide 39 running on a cam track of a cam 40 disposed for moving the head 27 as shown in FIG. 1.

The operation of the yarnguides 30 for the toothed rollers 8 and 9, by way of the tierods 34, is controlled by the moving yarnguides 5 of the striper 1, as seen in FIG. 1, with the aid of a crank lever 41, as a mechanical solution. An electromagnetic solution is feasible as shown in FIGS. 7 to 10, with a suitably programmed electromagnet.

Figure 5:
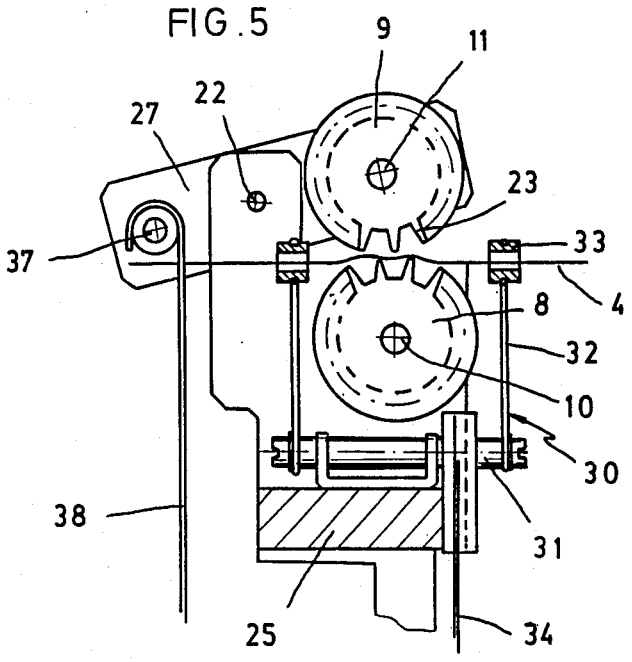
FIG. 5 is a view similar to that of FIG. 4 showing the toothed rollers being opened.
Figure 6:
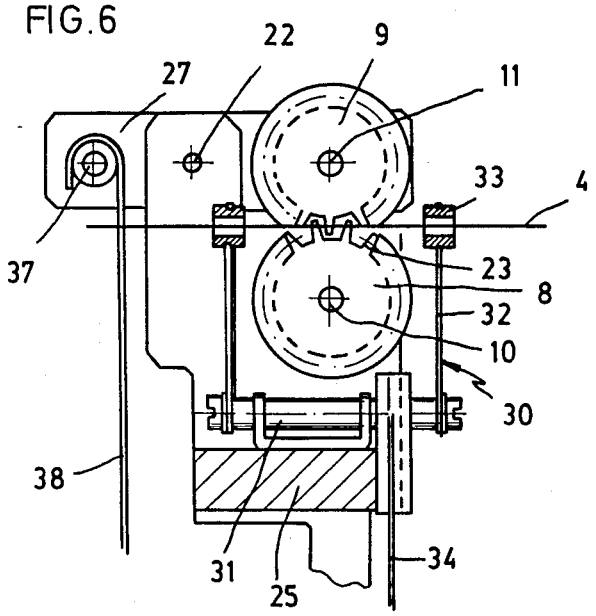
FIG. 6 is a view similar to those of FIGS. 4 and 5, showing the toothed rollers in an inoperative position.

FIG. 4 shows the yarnguide in the yarn feed position. The yarn is caught by the teeth 23 of rollers 8 and 9 and delivered at constant speed to the needles 2. FIG. 6 shows the yarnguide in the non-feeding position and in this position there is no engagement between the yarn 4 and the said rollers 8 and 9. Figure 5 relates to the first position mentioned which, in the needle removal zone on a striper change, continues in the feed position but delivering a lesser amount of yarn since, by pivoting of the support head 27, the engagement between the teeth 23 of the rollers 8 and 9 is less and therefore the amount of yarn fed is less, corresponding to the small amount used in the needle removal zone.

Figure 10:
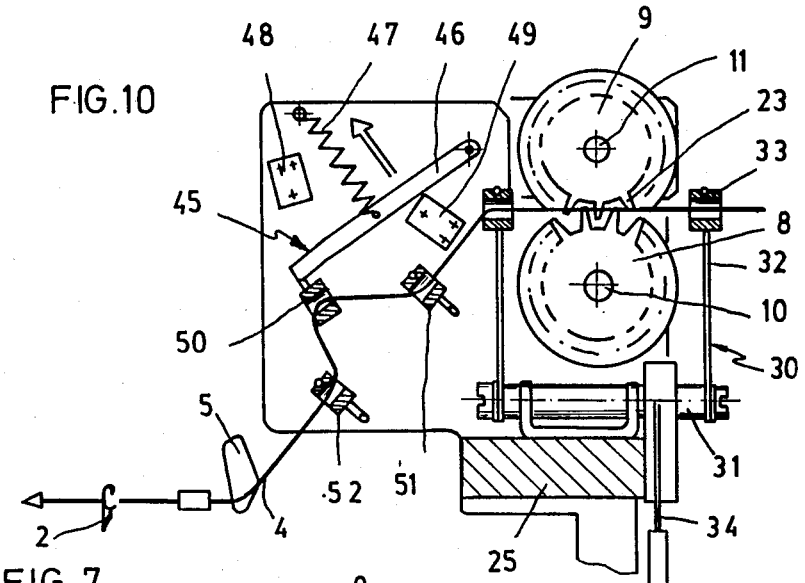
FIG. 10 is a view similar to that of FIGS. 7 to 9, showing the start of the yarn non-feeding position.
Figure 7:
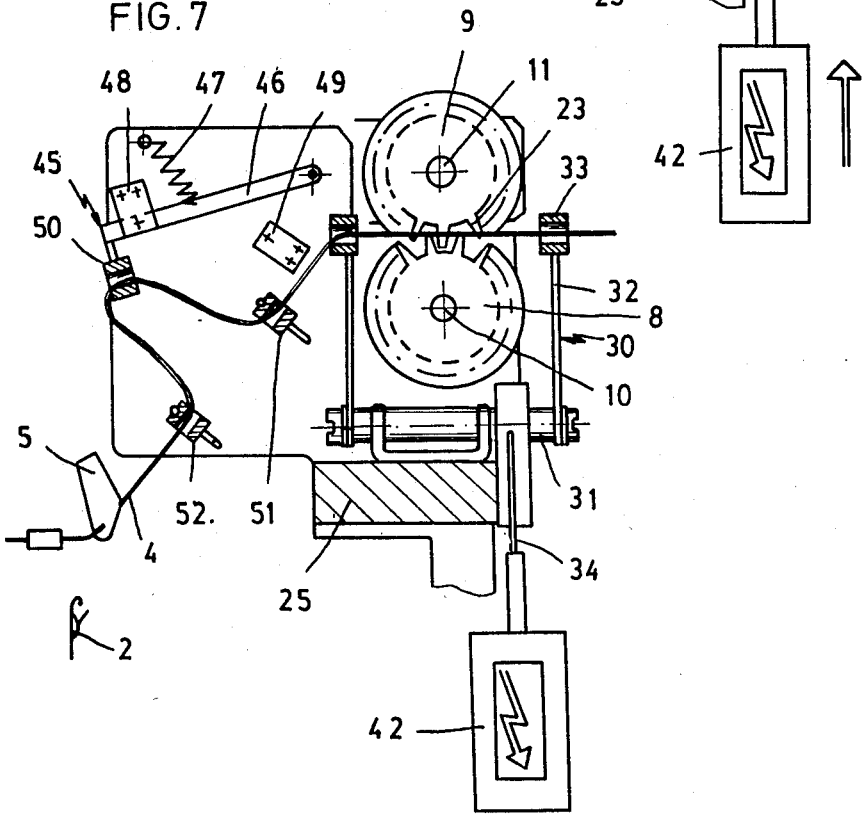
FIG. 7 is a view of the toothed rollers of the yarn feed device, provided with a yarn tension detector, in the non-feeding position according to a second embodiment of the present invention.

FIGS. 7 and 10 show the running of the striper yarn 4 in the different stages of a cycle, with the intervention of a sensor 45 formed by a lever 46 connected to a traction spring 47 and movable between photoelectric sensors 48 and 49, the lever 46 being provided with a yarnguide eyelet 50 for the yarn 4 guided by a further two fixed leading and trailing eyelets 51 and 52.

Figure 8:
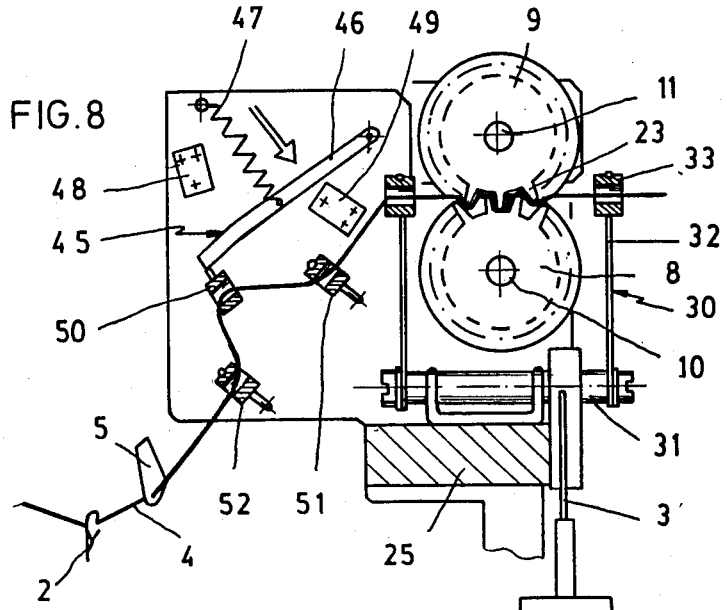
FIG. 8 is a view similar to that of FIG. 7, showing the start of the yarn feed stage.

As shown in FIG. 8, the striper yarn 4 starts the feed stage to the needles 2, whereby the sensor gives way under the tension of the yarn, breaking contact with the sensor 48 which immediately sends a command signal to the electromagnet 42 associated with the yarnguide 30 which pivots to place the yarn in the contact and feed area of the rollers 8 and 9.

Figure 9:
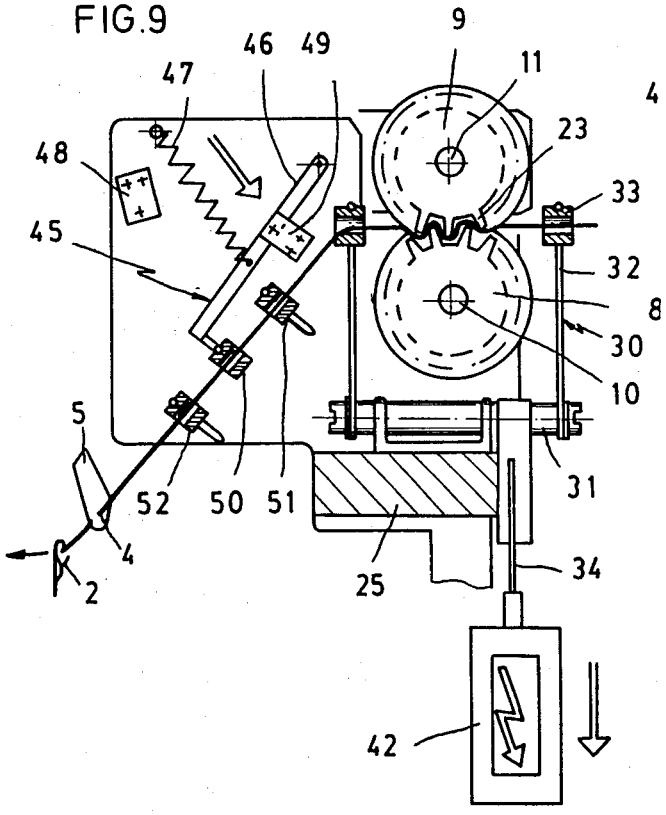
FIG. 9 is a view similar to that of FIGS. 7 and 8, showing the yarn feed stage.

FIG. 9 shows the yarn 4 being fed to the needles 2, whereby the eyelet 50 of the lever 46 is fully aligned with the eyelets 51 and 52, in which position the lever 46 intercepts the light ray of sensor 49.

FIG. 10 shows the moment of the striping changeover, whereby the yarn becomes slack, the lever 46 pivots and ceases to obstruct the sensor 49. Immediately the electromagnet operates and removes the yarnguide 30 from the feed zone. Under these conditions, the yarn 4 ceases to be knit by the needles.

FIG. 7 shows the non-feeding yarnguides in the rest position, with the lever 46 blocking the light ray of sensor 48 and a new cycle is started.

For operating the yarnguides 5 as shown in FIG. 1, there is a mechanism mounted on the fixed frame 55 which mechanism is disclosed in Spanish Pat. No. 481,545. On the the frame 56 there moves a control device 56 which actuates an arm 59 connected to a traction spring 60 through pushers 57 and further intermediate pushers 58. Arm 59 is provided with a pawl 61 for a ratchet wheel provided with pins 63 which actuate in each case the said levers 6 of each of the yarnguides 5.

Figure 11:
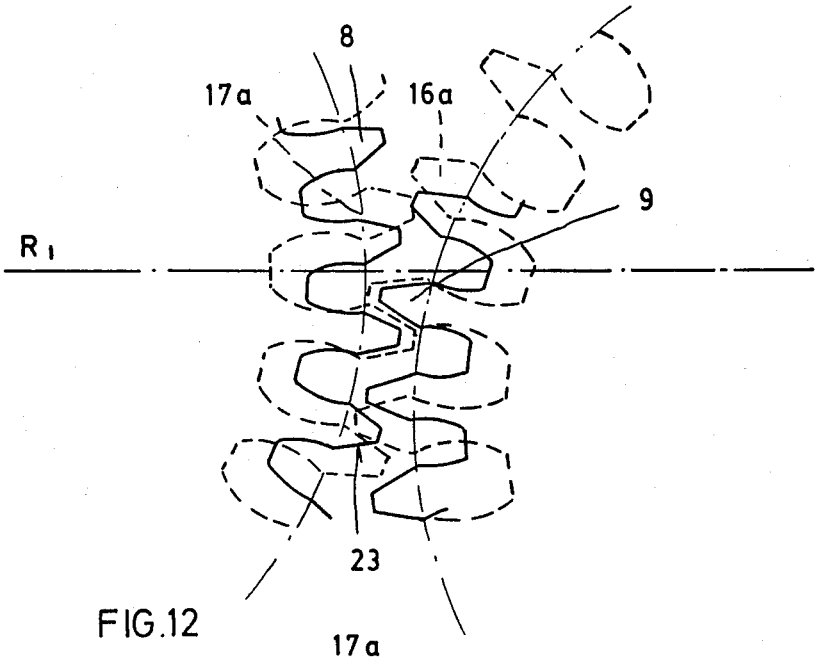
FIG. 11 is a view of the position of maximum separation of the drive gears, with corrected modulus according to a third embodiment of the present invention, without contact being made between the roller teeth.
Figure 12:
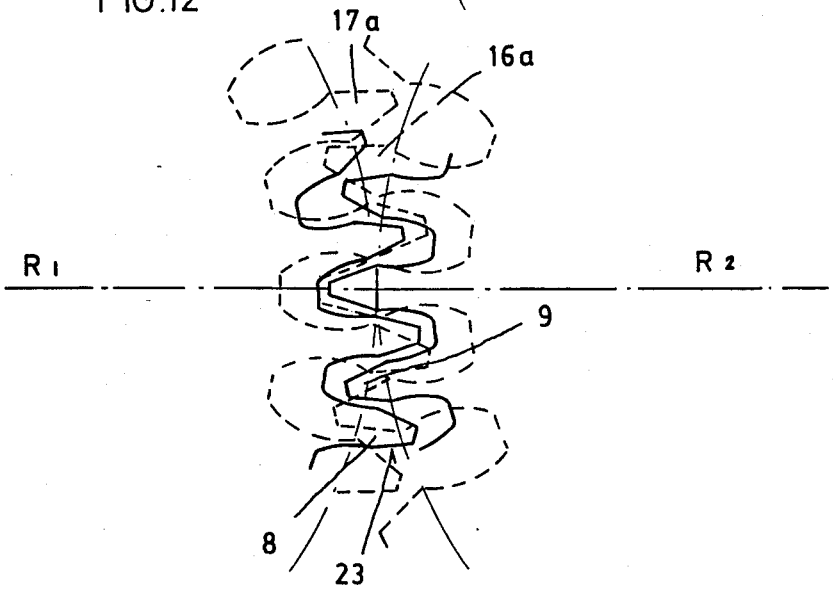
FIG. 12 is a view similar to that of FIG. 11, showing the gears in the minimum separation position thereof, without there being direct contact between the rollers either.

An alternative embodiment of the invention is shown in FIGS. 11 and 12 in which pinions 16*a* and 17*a* replace the pinions 16 and 17, to give a simplified mechanism. In this embodiment, the pinions 16*a* and 17*a* are of corrected modulus as shown in the figures. On the one hand, this simplifies the mechanism since the above described intermediate pinions 18 and 19 become unnecessary and on the other there is no contact under any circumstance between the teeth 23 of the rollers 8 and 9. This is shown in FIGS. 11 and 12, the former showing the maximum separation between the pinions 16*a* and 17*a*, while the latter shows the minimum separation between the rollers, such that in the former case there is a smaller meshing zone between the rollers 8 and 9 and in the latter a larger meshing zone for effective feeding of the yarns.

Both figures show the mean radius $R_1$ for the corrected modulus teeth of pinion 17*a* which in FIG. 12 is aligned with the radius $R_2$ of pinion 16*a*, while in FIG. 11, the radii are not aligned due to the shift between the pinions.

What I claim is:

1. A yarn feed device for a circular knitting machine equipped with a striper, comprising:

(a) two parallel facing shafts which rotate in synchronism and are separated from one another, each of said shafts having mounted thereon a set of identical toothed rollers such that each of the drive rollers of one set is adapted to mesh with a mating driven roller of the other set, the teeth of the rollers of one set being shifted relative to those of the other so that, in rotation, the teeth of the one penetrate between the teeth of the other without making contact at any point;

(b) operating spaces between the toothed rollers of each set;

(c) a bevelled corner on the toothed rollers facing the corresponding operating space;

(d) a drive and a driven pinion mounted respectively on the parallel shafts, the drive pinion being adapted to cause the driven pinion to rotate;

(e) a yarnguide for each operating space, hingedly mounted on a shaft and including two eyelets defining a line capable of occupying an inoperative position extending through in an operating space or an operative position extending between a pair of rollers;

(f) an actuating lever for each yarnguide;

(g) a support head for hingedly mounting one of said parallel shafts; and (h) activating means in the striper for receiving the yarn, each of said yarnguide actuating levers being associated with the activating means of the striper at the same time as the support head of said one of said parallel shafts is associated with drive means synchronized with the rotation of the circular knitting machine and acting upon the striper.

2. The feed device of claim 1, wherein the activating means comprises a yarnguide of the striper.

3. The feed device of claim 2, wherein the actuating levers of the yarnguides for each operating space and the yarnguides corresponding to the striper are mechanically connected.

4. The feed device of claim 2, wherein the actuating levers of the yarnguides for each operating space and the yarnguides corresponding to the stripe are connected by electromagnetic means.

5. The feed device of claim 1, wherein the drive means comprises a moving cam rotating in synchronism with the circular knitting machine.

6. The feed device of claim 1, wherein rotation of the driven pinion from the rotation of the drive pinion is caused by a first intermediate pinion and a second intermediate pinion which mesh, said first intermediate pinion also being meshed with said drive pinion and said second intermediate pinion being meshed with said drive pinion.

7. The feed device of claim 1, wherein the drive pinion and the driven pinion may be directly meshed by milling the teeth thereof with a corrected modulus so that the teeth of the toothed rollers do not make contact.

* * * * *